US011145157B2

(12) United States Patent
McKay

(10) Patent No.: US 11,145,157 B2
(45) Date of Patent: Oct. 12, 2021

(54) GAMING MACHINE AND METHOD FOR TRANSFERRING GAME METER DATA TO A PORTABLE DEVICE

(71) Applicant: Aristocrat Technologies Australia Pty Limited, North Ryde (AU)

(72) Inventor: Linn Anthony McKay, Henderson, NV (US)

(73) Assignee: ARISTOCRAT TECHNOLOGIES AUSTRALIA PTY LIMITED

( * ) Notice: Subject to any disclaimer, the term of this patent is extended or adjusted under 35 U.S.C. 154(b) by 99 days.

(21) Appl. No.: 16/388,359

(22) Filed: Apr. 18, 2019

(65) Prior Publication Data

US 2019/0244468 A1 Aug. 8, 2019

Related U.S. Application Data

(63) Continuation of application No. 12/435,131, filed on May 4, 2009, now Pat. No. 10,297,101.

(60) Provisional application No. 61/050,022, filed on May 2, 2008.

(51) Int. Cl.
*G07F 17/32* (2006.01)

(52) U.S. Cl.
CPC ..... *G07F 17/32* (2013.01); *G07F 17/323* (2013.01); *G07F 17/3218* (2013.01); *G07F 17/3232* (2013.01); *G07F 17/3234* (2013.01)

(58) Field of Classification Search
CPC .. G07F 17/3223; G07F 17/3251; G07F 17/32; G07F 17/3218; G07F 17/323; G07F 17/3232; G07F 17/3234
See application file for complete search history.

(56) References Cited

U.S. PATENT DOCUMENTS

| | | | |
|---|---|---|---|
| 5,179,517 | A | 1/1993 | Sarbin et al. |
| 6,165,071 | A | 12/2000 | Weiss |
| 6,308,887 | B1 | 10/2001 | Korman et al. |
| 6,318,536 | B1 | 11/2001 | Korman et al. |
| 6,716,102 | B2 | 4/2004 | Whitten et al. |
| 6,929,264 | B2 | 8/2005 | Huard et al. |
| 7,591,725 | B2 | 9/2009 | Gatto et al. |

(Continued)

FOREIGN PATENT DOCUMENTS

| | | |
|---|---|---|
| AU | 2008203836 | 8/2008 |
| CA | 2486648 | 4/2001 |

(Continued)

OTHER PUBLICATIONS

White, Ron, How Computers Work, 9th Ed., Que Corporation, Nov. 14, 2007.

(Continued)

*Primary Examiner* — David L Lewis
*Assistant Examiner* — Robert E Mosser
(74) *Attorney, Agent, or Firm* — McAndrews, Held & Malloy, Ltd.

(57) ABSTRACT

A gaming system is disclosed which comprises a game controller arranged to implement a game, at least one game meter arranged to obtain game related information, and an interface device arranged to facilitate transfer of at least some of the obtained game related information to a portable data storage device in response to a transfer instruction. A corresponding method of monitoring a gaming device is also disclosed.

15 Claims, 4 Drawing Sheets

(56) References Cited

U.S. PATENT DOCUMENTS

| | | | | |
|---|---|---|---|---|
| 7,618,317 | B2 | 11/2009 | Jackson | |
| 7,676,584 | B2 | 3/2010 | Klitsner et al. | |
| 2001/0035859 | A1 | 11/2001 | Kiser et al. | |
| 2002/0077177 | A1 | 6/2002 | Elliott | |
| 2003/0045354 | A1 | 3/2003 | Giobbi | |
| 2004/0023721 | A1 | 2/2004 | Giobbi | |
| 2004/0087364 | A1 | 5/2004 | Ishikawa | |
| 2005/0130745 | A1 | 6/2005 | Dernis et al. | |
| 2005/0143164 | A1 | 6/2005 | Duhamel et al. | |
| 2005/0143169 | A1 | 6/2005 | Nguyen et al. | |
| 2005/0278755 | A1 | 12/2005 | Kuo et al. | |
| 2006/0068911 | A1 | 3/2006 | Pirich et al. | |
| 2006/0154722 | A1* | 7/2006 | Walker | G07F 17/32 463/25 |
| 2006/0178208 | A1 | 8/2006 | Cole | |
| 2006/0211470 | A1 | 9/2006 | Walker et al. | |
| 2006/0247020 | A1 | 11/2006 | Fujimori | |
| 2006/0287108 | A1 | 12/2006 | Canterbury | |
| 2007/0232381 | A1* | 10/2007 | Sato | G07F 17/3209 463/20 |
| 2008/0015004 | A1* | 1/2008 | Gatto | G07F 17/3223 463/16 |
| 2008/0268934 | A1 | 10/2008 | Malice et al. | |
| 2008/0305844 | A1 | 12/2008 | Davis et al. | |
| 2008/0318672 | A1 | 12/2008 | Ramaswamy et al. | |
| 2010/0016075 | A1 | 1/2010 | Thomas | |

FOREIGN PATENT DOCUMENTS

| | | | |
|---|---|---|---|
| CN | 1439949 | | 9/2003 |
| CN | 1442821 | | 9/2003 |
| CN | 1838135 | | 9/2006 |
| DE | 202005013381 | | 10/2005 |
| GB | 1163535 | | 9/1969 |
| GB | 2435538 | | 8/2007 |
| JP | 2004008799 | | 1/2004 |
| JP | 2004208817 | | 7/2004 |
| JP | 2005319191 | | 11/2005 |
| JP | 2005319192 | | 11/2005 |
| JP | 2005319193 | | 11/2005 |
| JP | 2005334274 | | 12/2005 |
| JP | 2006006494 | | 1/2006 |
| JP | 2006148437 | | 6/2006 |
| JP | 2006149422 | | 6/2006 |
| JP | 2006190091 | | 7/2006 |
| JP | 2006254942 | | 9/2006 |
| JP | 2006271658 | | 10/2006 |
| KR | 200100085489 | | 9/2001 |
| KR | 20020003600 | | 1/2002 |
| KR | 20020007518 | | 1/2002 |
| KR | 20020014251 | | 2/2002 |
| KR | 20020050727 | | 6/2002 |
| KR | 20020088058 | | 11/2002 |
| KR | 20030060738 | | 7/2003 |
| KR | 1004159668 | | 1/2004 |
| KR | 2004009241 | | 11/2004 |
| KR | 20050022448 | | 3/2005 |
| WO | 2000007088 | A1 | 2/2000 |
| WO | WO2005098650 | | 10/2005 |
| WO | WO2006079255 | | 8/2006 |
| WO | WO2007045020 | | 4/2007 |

OTHER PUBLICATIONS

Derfler, Frank J. et al., How Networks Work, 7th Ed., Que Corporation, Oct. 18, 2004.

Gralia, Preston, How Wireless Works, 2nd Ed., Que Corporation, Oct. 24, 2005.

White, Ron, How Computers Work, 7th Ed., Que Corporation, Oct. 15, 2003.

Australian Examination Report No. 1 issued in AU2019203253, dated May 14, 2020, 5 pages.

* cited by examiner

GAMING MACHINE AND METHOD FOR TRANSFERRING GAME METER DATA TO A PORTABLE DEVICE

RELATED APPLICATIONS

This application is a continuation of U.S. application Ser. No. 12/435,131 having a filing date of May 4, 2009, which claims priority to U.S. Provisional Application No. 61/050,022 having a filing date of May 2, 2008, all of which are incorporated herein by reference in its entirety.

BACKGROUND OF THE INVENTION

The present invention relates to a gaming system and to a method of monitoring a gaming device. It is known to provide a gaming system which comprises a game controller arranged to implement a game and a player interface usable by a player to play the game. In some gaming systems, game meters are also provided for monitoring attributes of game play such as coin in/coin out data, the number of games played, the number of wins, and so on.

However, with such gaming systems the task of manually extracting data from the meters is cumbersome and prone to error.

BRIEF SUMMARY OF THE INVENTION

In accordance with a first aspect of the present invention, there is provided a gaming system comprising:

a game controller arranged to implement a game;

at least one game meter arranged to obtain game related information; and an interface device arranged to facilitate transfer of at least some of the obtained game related information to a portable data storage device in response to a transfer instruction.

In one embodiment, the gaming system further comprises a data storage device arranged to store at least some of the game related information obtained by the at least one game meter.

In one embodiment, the interface device comprises a USB interface arranged to mechanically and electrically connect with a portable USB data storage device.

In addition or alternatively, the interface device comprises a wireless communication interface arranged to communicate wirelessly with a portable data storage device. The wireless communication interface may comprise a Bluetooth or WiFi communication interface.

In one embodiment, the gaming system comprises an authorization device arranged to permit access to the obtained game related information by a person only when the identity of the person has been verified.

The authorization device may be arranged to receive an authorization code from a person, to compare the authorization code with a reference authorization code, and to permit access to the obtained game related information if the entered authorization code and the reference authorization code match.

In one embodiment, the gaming system comprises an identification device reader and the reference authorisation code is stored on an identification device which may be an identification card, the identification device reader being arranged to extract the authorization code from the identification device when the identification device is engaged with the identification device reader.

In one embodiment, the gaming system is arranged to transfer at least some of the obtained game related information to a portable data storage device in response to a transfer instruction received from a person.

In an alternative embodiment, the gaming system is arranged to transfer at least some of the obtained game related information to a portable data storage device in response to a transfer instruction generated automatically when a connection is established between the interface device and the portable data storage device.

The game related information may comprise information indicative of the number of credits received and dispensed by the gaming system, the number of games played and/or the number of wins.

The game related information may comprise security information indicative of whether a door of the gaming system has been opened and/or whether a tilt has occurred during game play.

The game related information may comprise screen shot data indicative of at least some of the screens displayed to a player during game play.

In one embodiment, the gaming system comprises a plurality of gaming machines, each gaming machine comprising:

at least one game meter arranged to obtain game related information; and an interface device arranged to facilitate transfer of at least some of the obtained game related information to a portable data storage device in response to a transfer instruction.

In accordance with a second aspect of the present invention, there is provided a method of monitoring a gaming device, the method comprising:

obtaining game related information from at least one game meter; and transferring at least some of the obtained game related information to a portable data storage device in response to a transfer instruction.

BRIEF DESCRIPTION OF SEVERAL VIEWS OF THE DRAWINGS

The present invention will now be described, by way of example only, with reference to the accompanying drawings, in which.

DETAILED DESCRIPTION OF THE INVENTION

Figure 1:
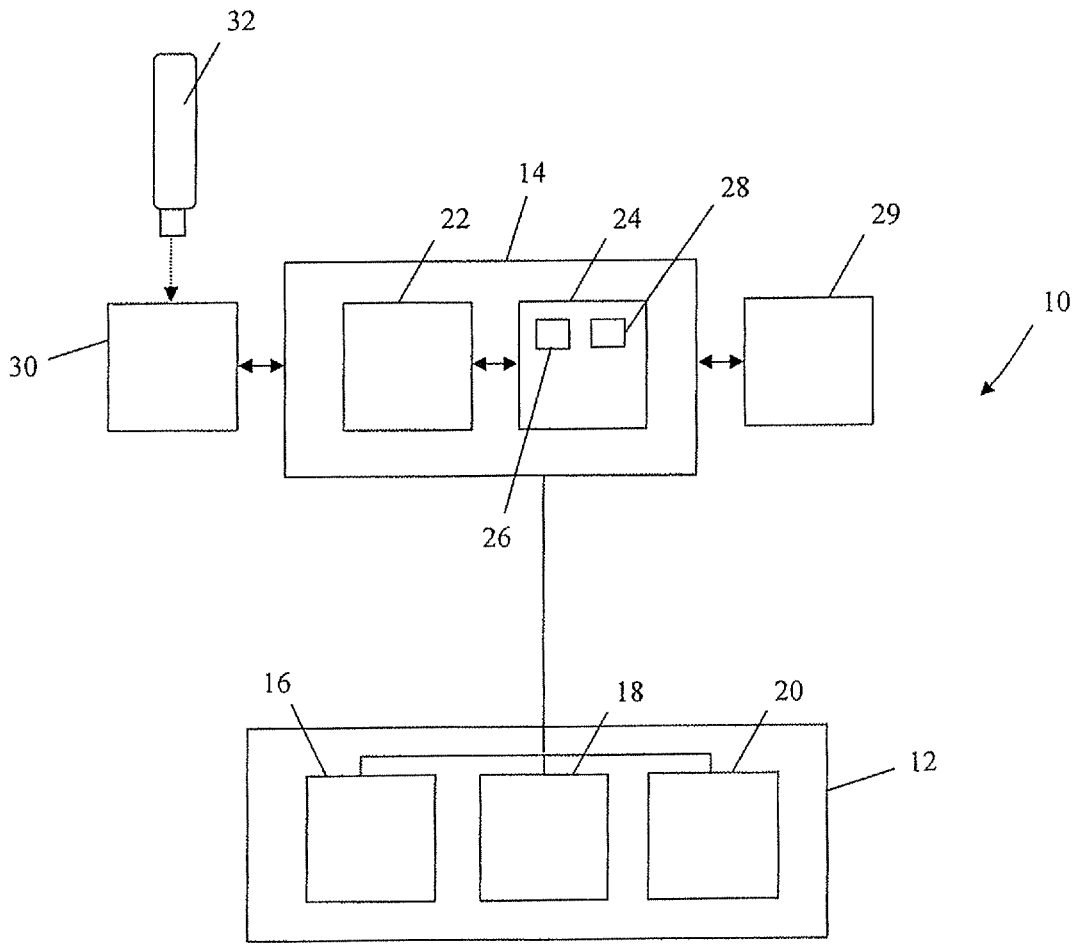
FIG. 1 is a schematic block diagram of core components of a gaming system in accordance with an embodiment of the present invention.

Referring to the drawings, there is shown a schematic block diagram of a gaming system 10 arranged to implement a probabilistic game, in this example of the type wherein several symbols from a set of symbols are randomly displayed, and a game outcome is determined on the basis of the displayed symbols.

With some such probabilistic games, the set of symbols used include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display along a win line, or are displayed according to defined outcome patterns such as scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

Referring to FIG. 1, a schematic diagram of core components of a gaming system 10 in accordance with the present embodiment is shown. The core components comprise a player interface 12 and a game controller 14. The player interface 12 is arranged to enable interaction between a player and the gaming system and for this purpose includes input/output components required for the player to enter instructions and play the game.

Components of the player interface 12 may vary but will typically include a credit mechanism 16 to enable a player to input credits and receive payouts, one or more displays 18 which may comprise a touch screen, and a game play mechanism 20 arranged to enable a player to input game play instructions.

The game controller 14 is in data communication with the player interface 12 and typically includes a processor 22 arranged to process game play instructions and output game player outcomes to the display 18. Typically, the game play instructions are stored as program code 26 in a memory 24 that can also be hardwired. It will be understood that in this specification the term "processor" is used to refer generically to any device that can process game play instructions and may include a microprocessor, microcontroller, programmable logic device or other computational device such as a personal computer or a server.

In this example, the memory 24 also stores game related data including meter data 28 derived from at least one game meter 29. The meter data 28 includes information indicative of the number of credits received and dispensed by the gaming system 10, and may also include information indicative of the number of games played, the number of wins, and any other game related data. The meter data may also include security information such as information indicative of whether a door of the gaming system cabinet has been opened, a tilt has occurred during game play, and so on.

The meter data 28 may also include screen shot data representative of at least some of the screens displayed to a player during game play. The screen shot data may be used to analyse game outcomes subsequent to completion of games, for example so as to provide an indication as to the screens displayed during a winning outcome or during a perceived fault such as a false jackpot.

The memory 24 is also arranged to store symbols data indicative of a plurality of symbols, in the present example associated with a plurality of reels, and function data indicative of one or more functions allocatable to the symbols.

The gaming system 10 also includes an interface device 30 arranged under control of the processor 22 to facilitate transfer of at least some of the meter data 28 stored in the memory 24 from the memory 24 to a portable data storage device 32. In this example, the interface device 30 is a USB interface and the portable data storage device 32 is a USB memory device mechanically and electrically connectable to the USB interface.

The gaming system also comprises an authorisation arrangement, in this example in the form of authorisation program code 26 stored in the memory 24 and arranged in association with the processor 22 to control access to a system menu, in particular so as to ensure that only authorised persons are able to access the meter data. The system menu provides an authorised person with a user friendly interface usable to instruct the gaming system 10 to transfer at least some of the meter data from the memory 24 to a portable data storage device 32 connected to the interface device 30. Authorisation of a person may be carried out by requesting entry of a password, or in any other way. Where the interface device 30 is wireless the user may be prompted from a portable device to enter information to interface with the authorization program code 26 to control access to the system menu.

For example, in an alternative authorisation arrangement, the portable data storage device 32 may include a unique identifier which is compared by the processor 22 with a reference identifier stored in the memory 24 in order to determine whether the portable data storage device is genuine.

In a further alternative authorisation arrangement, the gaming system may be provided with a reader which may be in the form of a player tracking device, and the person authorised to access the meter data provided with an identification card readable by the player tracking device and including information identifying the person. Insertion of the identification card into the player tracking device first causes the player tracking device to verify that the person indicated on the card is authorised to gain access to the meter data, and secondly causes a request to be made for the person to enter an authorisation code such as a PIN number. Verification of the PIN number causes access to the meter data to be permitted.

In a further alternative arrangement, no authorisation is required. With this arrangement, other security measures may be included, such as providing the interface device and the portable data storage device with proprietary complementary connectors.

While the present example is described in relation to a USB interface device 30 and a corresponding portable USB data storage device, it will be understood that other arrangements are possible for facilitating transfer of meter data from the memory 24 to the portable data storage device 30. For example, the gaming system 10 may be provided with a wireless interface device, for example arranged to communicate with a portable data storage device using Bluetooth®, other "near field" communication schema or WiFi communications. With this arrangement, it will be understood that it is not necessary to mechanically engage the portable data storage device with the interface device 30.

In the present example, the gaming system is arranged such that meter data is transferred from the memory 24 to a portable data storage device 32 when actively instructed by a person, for example using a system menu. However, other arrangements are possible. For example, the gaming system, and in particular the processor 22 in association with program code 26 stored in the memory 24 may be arranged to transfer meter data to the portable storage device 32 automatically when a connection is established between the interface device 30 and the portable data storage device 32.

The gaming system 10 can take a number of different forms.

In a first form, a gaming device in the form of a stand alone gaming machine is provided wherein all or most components required for implementing a game are present in a player operable gaming machine.

In a second form, a distributed architecture is provided wherein some of the components required for implementing the game are present in a player operable gaming device in the form of a gaming terminal and some of the components required for implementing the game are located remotely relative to the gaming terminal. For example, a "thick client" architecture may be used wherein part of the game is executed on a player operable gaming terminal and part of the game is executed remotely, such as by a gaming server; or a "thin client" architecture may be used wherein most of the game is executed remotely such as by a gaming server and a player operable gaming terminal is used only to display audible and/or visible gaming information to the player and receive gaming inputs from the player.

However, it will be understood that other arrangements are envisaged. For example, an architecture may be provided wherein a gaming device is networked to a gaming server and the respective functions of the gaming device and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 2:
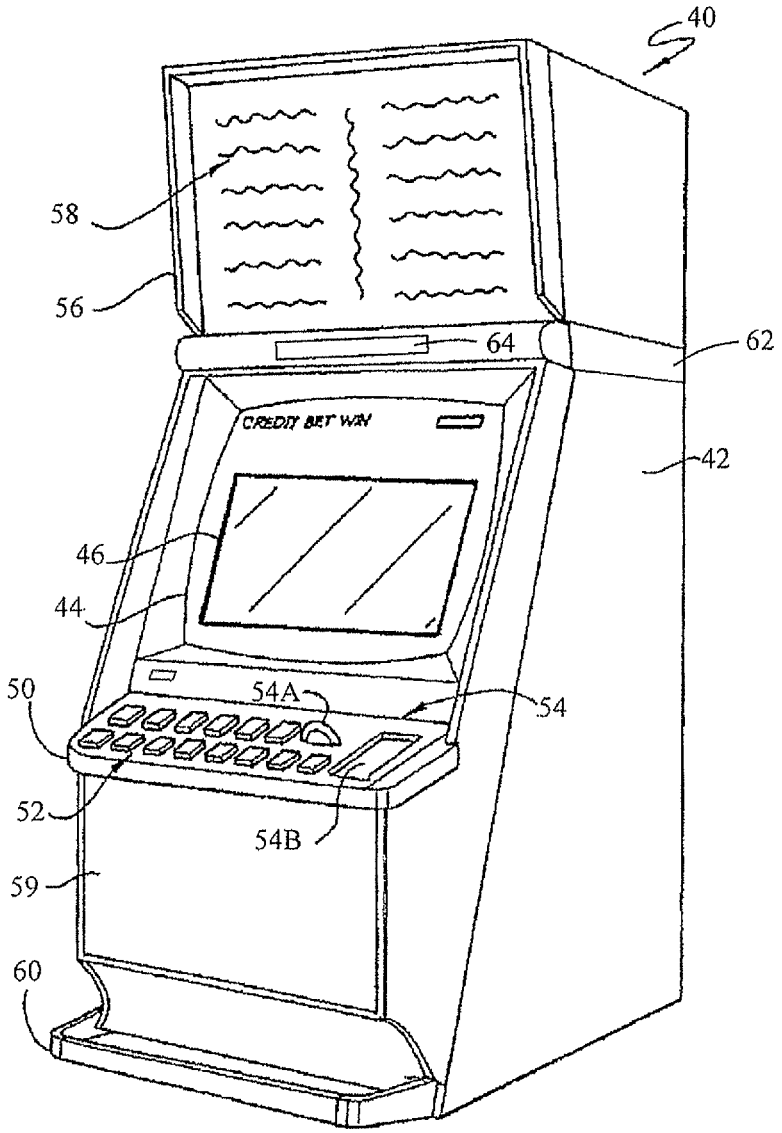
FIG. 2 is a diagrammatic representation of a gaming system in accordance with an embodiment of the present invention with the gaming system implemented in the form of a stand alone gaming machine.

A gaming system in the form of a stand alone gaming machine 40 is illustrated in FIG. 2. The gaming machine 40 includes a console 42 having a display 44 on which is displayed representations of a game 46 that can be played by a player. A mid-trim 50 of the gaming machine 40 houses a bank of buttons 52 for enabling a player to interact with the gaming machine, in particular during game play. The mid-trim 50 also houses a credit input mechanism 54 which in this example includes a coin input chute 54A and a bill collector 54B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 56 may carry artwork 58, including for example pay tables and details of bonus awards and other information or images relating to the game. Further artwork and/or information may be provided on a front panel 59 of the console 42. A coin tray 60 is mounted beneath the front panel 59 for dispensing cash payouts from the gaming machine 30.

The display 44 is in the form of a video display unit, particularly a cathode ray tube screen device. Alternatively, the display 44 may be a liquid crystal display, plasma screen, or any other suitable video display unit. The top box 56 may also include a display, for example a video display unit, which may be of the same type as the display 44, or of a different type. The display 44 may comprise a touch screen usable by a player to interact with the gaming machine, in particular during game play, and to interact with the system menu in order to cause transfer of meter data to a portable storage device.

The display 44 in this example is arranged to display representations of several reels, each reel of which has several associated symbols. During operation of the game, the reels first appear to rotate then stop with at least one symbol visible on each reel. Game outcomes are determined on the basis of the visible symbols together with any special functions associated with the symbols.

A player marketing module (PMM) 62 having a display 64 is connected to the gaming machine 10. The main purpose of the PMM 62 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. The PMM 62 may also be arranged to read identification information from an identification card in order to authorise a person to gain access to meter data stored in the gaming machine memory.

The gaming system 40 also includes the interface device 30, in this example in the form of a USB interface, mounted on the console 42 so as to be readily accessible.

Figure 3:
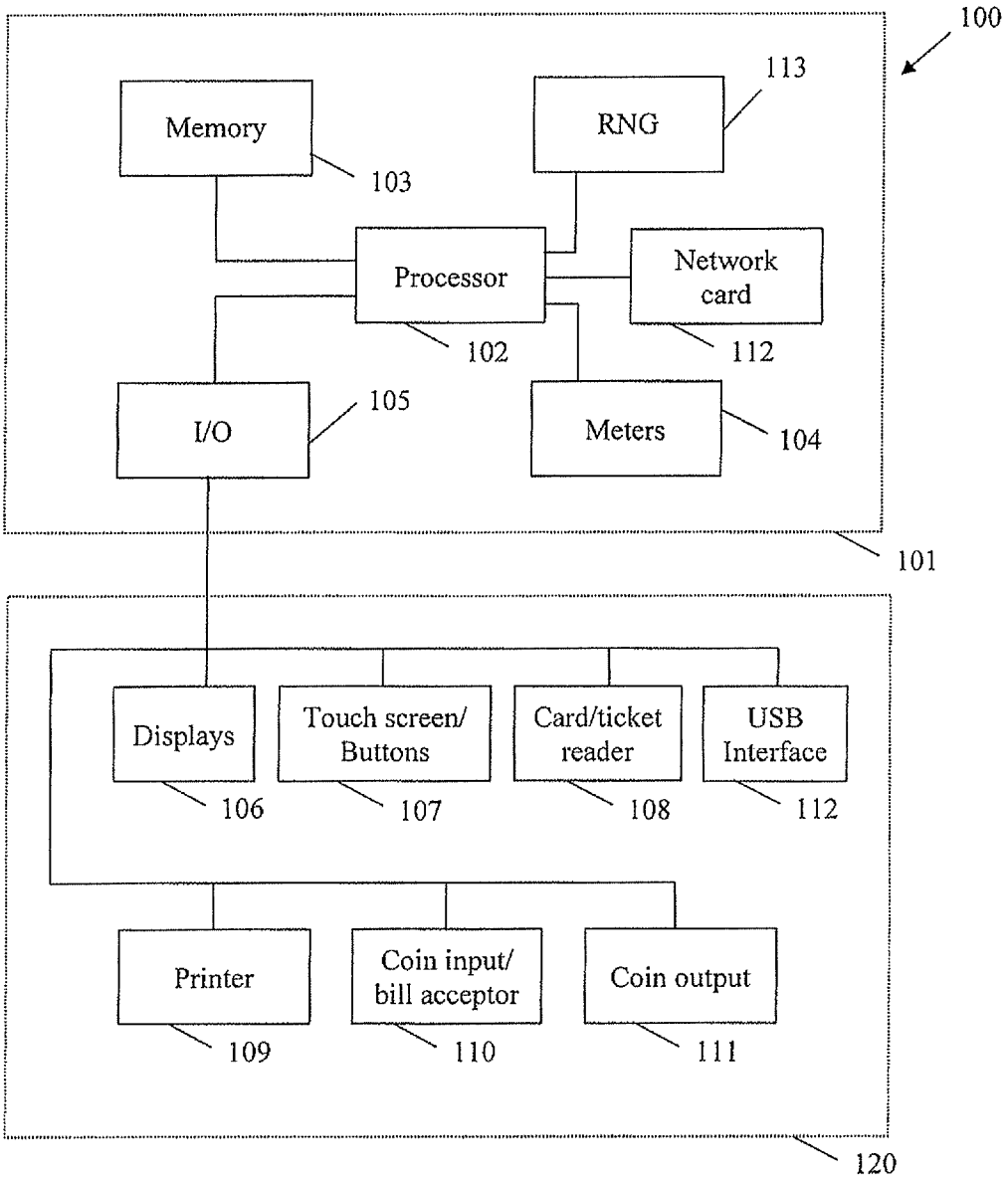
FIG. 3 is a schematic block diagram of operative components of the gaming machine shown in FIG. 2.

FIG. 3 shows a block diagram of operative components of a gaming machine 100 which may be the same as or different to the gaming machine shown in FIG. 2.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 4:
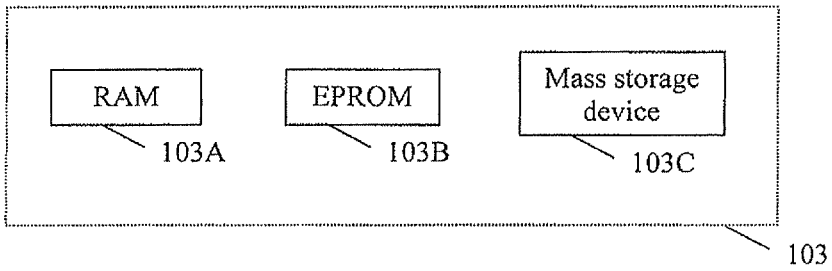
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere, and meter data 28.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 3, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111, and a USB interface 112 for mechanically and electrically engaging with a portable USB storage device. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106,107,108,109,110,111 may be provided remotely from the game controller 101.

An example of a specific implementation of a gaming system will now be described in relation to a stand alone gaming machine 10, 40 although it will be understood that implementation may also be carried out using other gaming system architectures such as a network architecture.

Figure 5:
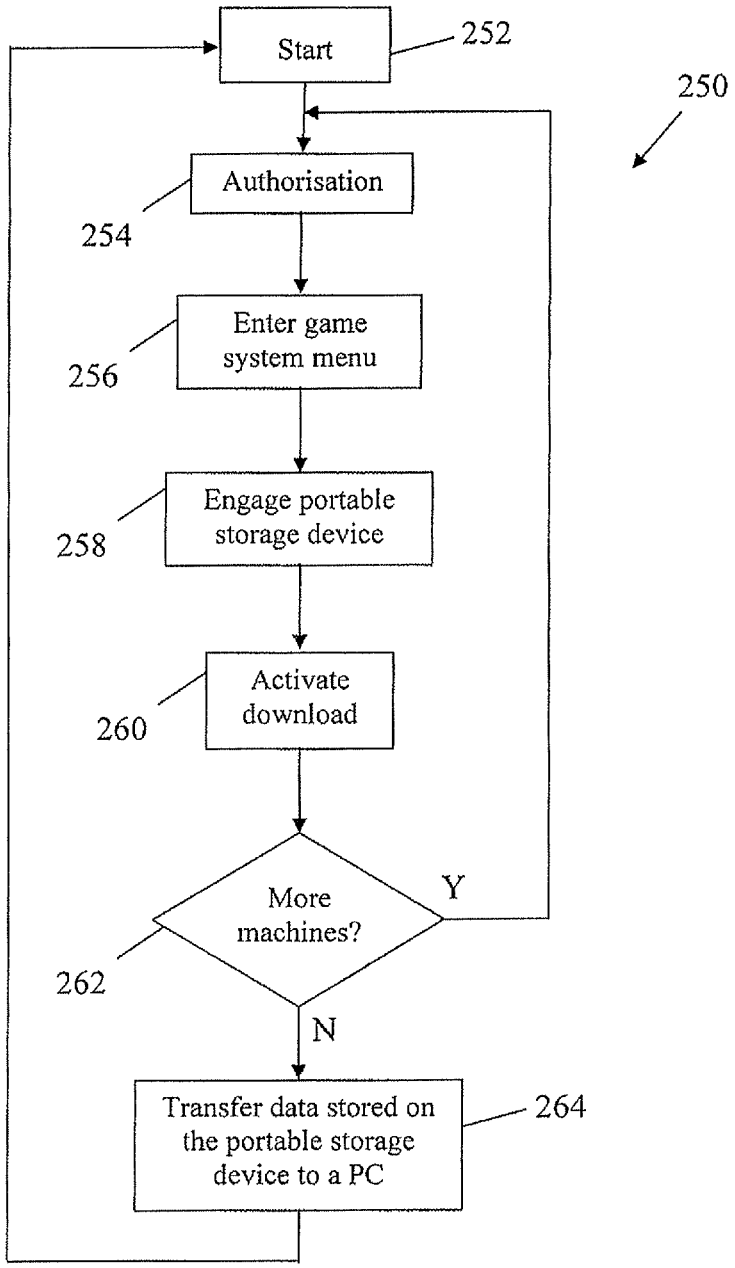
FIG. 5 is a flow diagram illustrating a method of monitoring a gaming device in accordance with an embodiment of the present invention.

Steps 252 to 264 of a method of monitoring a gaming device according to the present embodiment are shown in a flow diagram 250 in FIG. 5.

Using the game play mechanism 20 and/or touch screen a representative of operators of the gaming system enters authorization information, in this example a username and PIN number, in order to verify the identity of the representative. Positive identification grants the representative access to a system menu which may be navigated using the game play mechanism 20 and/or touch screen. The representative then engages the portable storage device 32 with the interface device 30 and effects transfer of data from the memory 24 to the portable storage device 32 using the system menu. If more similar gaming machines are present, the representative may carry out a similar download operation with these machines.

After completion of all downloads, the data stored on the portable storage device may be transferred to a suitable computing device for analysis. In particular, for a gaming system which includes a plurality of gaming machines connected in networked relationship, the meter data stored on the portable data storage device 32 may be used to verify that the meter data obtained directly from the gaming machines corresponds to game related data obtained through the network.

It will be appreciated that the present invention is particularly suitable for gaming systems which include a plurality of gaming machines since it enables a person to obtain meter data directly from a plurality of gaming machines quickly and accurately.

In the claims of this application and in the description of the invention, except where the context requires otherwise due to express language or necessary implication, the words "comprise" or variations such as "comprises" or "comprising" are used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

Modifications and variations as would be apparent to a skilled addressee are deemed to be within the scope of the present invention.

What is claimed is:

1. A gaming machine comprising:
a video display unit;
at least one memory;
a card reader;
an interface device; and
at least one processor configured to execute instructions stored in the at least one memory, which when executed, cause the at least one processor to at least:
cause the video display unit to display play of a game;
maintain game meter data related to the play of the game in the at least one memory;
verify based, at least in part, on an identification card read via the card reader, that access to the game meter data is authorized; and
after verifying that access to the game meter data is authorized:
present a visual system menu via the video display unit;
cause the interface device to initiate a connection with a portable storage device; and
transfer the game meter data from the at least one memory to the portable storage device in response to a transfer instruction received via the visual system menu.

2. The gaming machine of claim 1, wherein the interface device comprises a USB interface configured to mechanically and electrically engage with the portable storage device prior to transferring the game meter data to the portable storage device.

3. The gaming machine of claim 1, wherein the interface device comprises one of a Bluetooth communication interface configured to communicate wirelessly with the portable storage device or a WiFi communication interface configured to communicate wirelessly with the portable storage device.

4. The gaming machine of claim 1, wherein the game meter data comprises a number of received credits received, a number of dispensed credits, a number of games played, and/or a number of wins.

5. The gaming machine of claim 1, wherein the game meter data comprises data indicative of whether a door of the gaming machine has been opened and/or whether a tilt has occurred during the play of the game.

6. The gaming machine of claim 1, wherein the game meter data comprises screen shot data indicative of at least some of screens displayed by the video display unit during the play of the game.

7. A gaming machine comprising:
a video display unit;
at least one memory;
a wireless interface device; and
at least one processor configured to execute instructions stored in the at least one memory, which when executed, cause the at least one processor to at least:
cause the video display unit to display play of a game;
send, via the wireless interface device, a prompt to a portable device for entry of information into the portable device;
receive, from the portable device via the wireless interface device, the information entered into the portable device in response to the prompt;
verify based, at least in part, on the information entered into the portable device that a request to transfer game meter data is authorized;
maintain game meter data related to the play of the game in the at least one memory, wherein the game meter data includes screen shot data representative of screens displayed during the play of the game, wherein the screen shot data permits subsequent confirmation, by a recipient of the transferred game meter data, of at least one winning outcome obtained during the play of the game; and after verifying the request to transfer the game meter data is authorized, cause the wireless interface device to transfer the game meter data comprising the screen shot data to the portable device.

8. The gaming machine of claim 7, wherein the wireless interface device comprises one of a Bluetooth communication interface configured to communicate wirelessly with the portable device or a WiFi communication interface configured to communicate wirelessly with the portable device.

9. The gaming machine of claim 7, wherein the game meter data comprises a number of received credits received, a number of dispensed credits, a number of games played, and/or a number of wins.

10. The gaming machine of claim 7, wherein the instructions, when executed by the at least one processor, further cause the at least one processor to cause the wireless interface device to automatically transfer the game meter data to the portable device in response to establishing a connection between the wireless interface device and the portable device.

11. A method of operating a gaming machine, the method comprising:

displaying, by a processor, on a video display unit of the gaming machine, a play of a game;

storing, by the processor, on a memory, game meter data related to the play of the game;

after verifying that access to a visual system menu is authorized, displaying, by the processor, on the video display unit, the visual system menu;

establishing, by the processor, a connection between a portable device and a wireless interface device of the gaming machine; and transferring, by the processor, at least some of the game meter data to the portable device via the wireless interface device in response to a transfer request initiated via the visual system menu.

12. The method of claim 11, further comprising:

prompting, via the connection established between the portable device and the wireless interface device, for entry of information into the portable device; and before transferring the at least some of the game meter data, verifying, based on the information entered into the portable device in response to prompting, that the transfer request is authorized.

13. The method of claim 12, wherein:

said storing game meter data comprises storing screen shot data indicative of at least some screens displayed by the video display unit of the gaming machine during the play of the game; and said transferring comprises transferring at least some of the screen shot data to the portable device.

14. The method of claim 11, wherein said storing the game meter data comprises storing a number of received credits received, a number of dispensed credits, a number of games played, and/or a number of wins.

15. The method of claim 11, wherein said storing the game meter data comprises storing data indicative of whether a door of the gaming machine has been opened and/or data indicative of whether a tilt has occurred during the play of the game.

* * * * *